US005377703A

United States Patent [19]

Chou et al.

[11] Patent Number: 5,377,703

[45] Date of Patent: Jan. 3, 1995

[54] DENTAL CLEANSING DEVICE

[76] Inventors: Tien-Fu Chou, No.37-5, Kuo-Pi Lane, Feng-Shan City, Kaohsiung Hsien; Mark Hsia, 10F, No.207-3, Wu-Miao Rd., Ling-Ya Dist., Kaohsiung City, both of Taiwan, Prov. of China

[21] Appl. No.: 124,306

[22] Filed: Sep. 20, 1993

[51] Int. Cl.[6] ..... A46B 11/00

[52] U.S. Cl. ..... 132/311; 433/147

[58] Field of Search ..... 132/310, 311 R; 433/125, 126, 141, 146, 147; 15/167.1

[56] References Cited

U.S. PATENT DOCUMENTS

| | | | |
|---|---|---|---|
| 1,063,523 | 6/1913 | Farrar | 132/311 |
| 1,166,269 | 12/1915 | Smith | 132/311 |
| 2,512,935 | 6/1950 | Hansen | 132/311 |
| 5,117,848 | 6/1992 | Huang | 132/311 |
| 5,123,841 | 6/1992 | Millner | 128/62 A |

*Primary Examiner*—Cary E. O'Connor
*Attorney, Agent, or Firm*—Darby & Darby

[57] ABSTRACT

A dental cleansing device includes an elongated hand grip member with an internal space that has a closed end and an open end, an elongated cover member with an insert end that can be connected detachably to the open end of the hand grip member, a holding end that is located opposite to the insert end, and a brush unit. The brush unit is provided on the holding end of the cover member and includes a brush seat which is fastened detachably to the holding end, a brush body integrally formed with the brush seat, and a plurality of hard and soft threads mixed together and wound along the brush body.

2 Claims, 2 Drawing Sheets

DENTAL CLEANSING DEVICE

BACKGROUND OF THE INVENTION

1. Field of the Invention

The invention relates to a cleansing device, more particularly to a dental cleansing device.

2. Description of the Related Art

After eating food, most people have a habit of cleaning their teeth so as to remove the bits of food which are stuck in the gaps between the teeth in order to prevent tooth decay and in order to maintain oral hygiene. Until now, conventional dental cleansing devices, such as toothpicks and dental flosses are generally used to clean the teeth after each meal.

Some of the drawbacks resulting from the use of the conventional dental cleansing devices are as follows:

(1) The cleansing operation is time-consuming since the toothpick or dental floss can only extend into or slide between a particular gap between adjacent two teeth.

(2) Constant prodding or picking at the gaps between the teeth would eventually expand the sizes of the gaps.

(3) The user of the toothpick may accidentally pick into the flesh adjacent to the gap he is cleansing, thereby resulting in unnecessary injury.

(4) The string of the dental floss may break off while cleaning the gap between adjacent two teeth, thus accidentally hurting the mouth of the user.

SUMMARY OF THE INVENTION

Therefore, a main objective of the present invention is to provide a dental cleansing device which does not have the above-mentioned drawbacks.

A second objective of the present invention is to provide a dental cleansing device which can clean the bits of food that are stuck in the gaps between the teeth more thoroughly than the conventional dental cleansing devices.

According to the present invention, the dental cleansing device includes a hollow elongated hand grip member which has an internal space with a closed end and an open end, and an elongated cover member which has an insert end that is fastened detachably to the open end of the elongated hand grip member and a holding end that is located opposite to the insert end. The holding end is provided with a brushing means that includes a brush seat which is attached detachably thereto, an elongated brush body which is formed integrally with the brush seat and a plurality of hairy threads wound around the brush body. When the brush means is removed from the cover member and the cover member is detached from the hand grip member, the brush means can be inserted into the hand grip member via the open end of the latter so as to keep the brush means in the internal space of the hand grip member. The elongated cover member further includes a clip attached to an exterior thereof, and the insert end of the cover member has a plurality of axially extending engaging ribs formed on the an external surface thereof to permit frictional retention of the insert end of the cover member in the open end of the hand grip member.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENT

Figure 1:
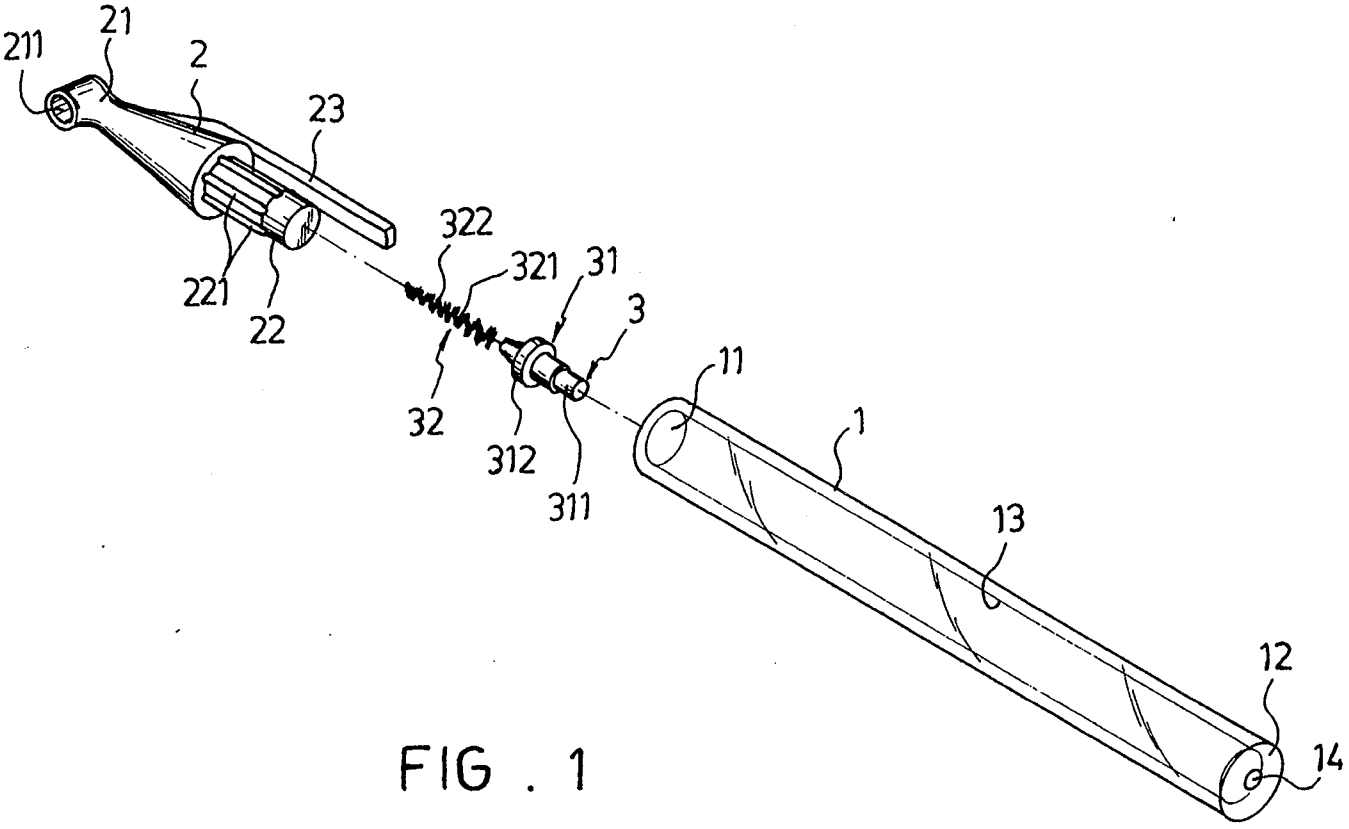
FIG. 1 is an exploded view of a dental cleansing device of the present invention.

Referring to FIG. 1, a dental cleansing device of the present invention is shown to comprise an elongated hand grip member 1, an elongated cover member 2 and a brush means 3.

The elongated hand grip member 1 has an internal space 13 with a closed end 12 and an open end 11. The closed end 12 is provided with a vent-hole 14 the purpose of which will be described in the succeeding paragraphs. The elongated cover member 2 has an insert end 22 and a holding end 21 which is located opposite to the insert end 22. The insert end 22 of the cover member 2 is provided with a plurality of axially extending engaging ribs 221 formed on an external surface of the same to permit frictional retention of the insert end 22 in the internal space 13 of the hand grip member 1 when the insert end 22 is inserted into the internal space 13 via the open end 11 of the latter. The holding end 21 of the cover member 2 is provided with a wall body 211 which confines a receiving space therein.

The brush means 3 includes a brush seat 31 with a positioning portion 311 which is in the shape of a cylinder with an annular flange 312 that is formed integrally therewith and that extends radially therefrom, and an elongated brush body 32 which extends axially, opposite to the positioning portion 311. The elongated brush body 32 is wound with a plurality of densely and substantially hard hairs 321 that are preferably made of plastics, and soft brushing threads 322 which are wound helically along the brush body 3 so as to extend radially therefrom.

Figure 3:
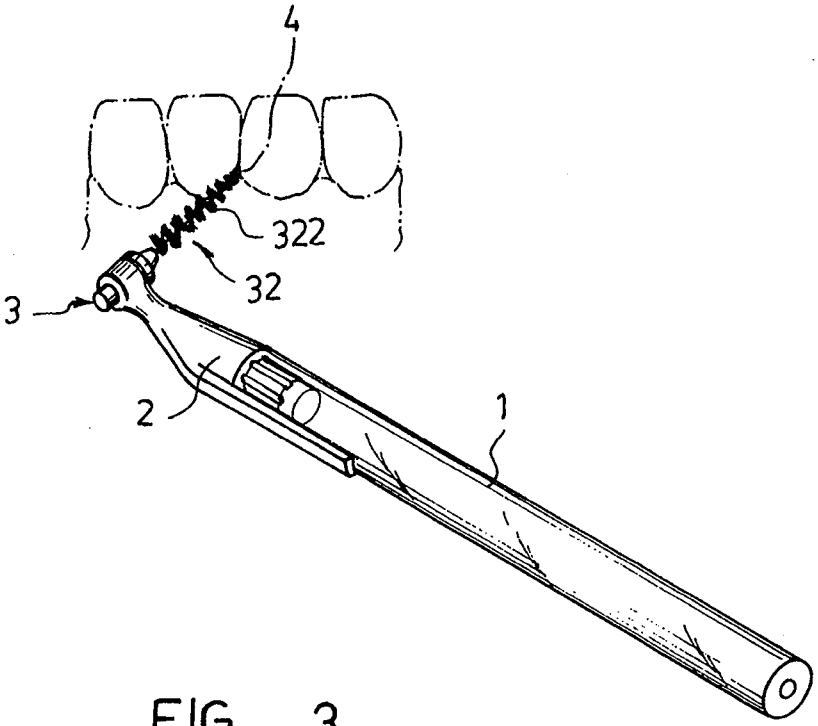
FIG. 3 illustrates the dental cleansing device of the present invention when in use.
Figure 2:
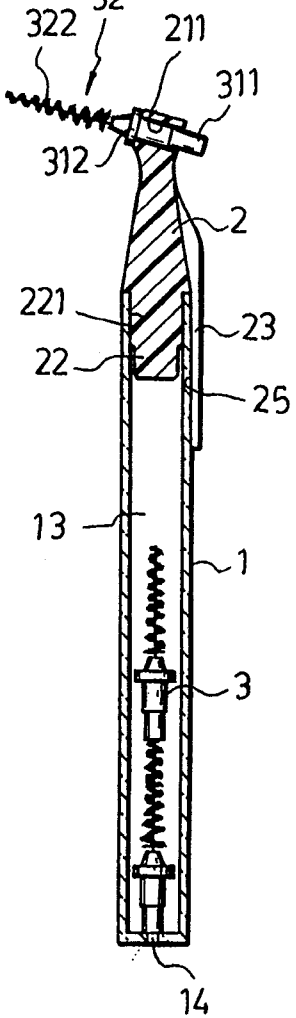
FIG. 2 is a cross section view of a dental cleansing device of the present invention.

Referring to FIG. 2, the positioning portion 311 is sized so as to be inserted within the receiving space confined by the wall body 211 at the holding end 21 of the cover member 2. The annular flange 312 abuts against the periphery of the wall body 211 such that the brush means 3 cannot extend through the same, thereby preventing the brush means 3 from disengaging the cover member 2 when in use, as shown in FIG. 3. After the brush means 3 is attached to the holding end 21 of the cover member 2, a section of the positioning portion 311 of the brush seat 31 projects out from one end of the wall body 211 at the holding end 21. Pressure on the projecting section of the positioning portion 311 can permit removal of the brush means 3 from the holding end 21 of the cover member 2.

Note that the internal space 13 in the hand grip member 1 is wide enough to accommodate at least three brush means 3 therein so that the brush means 3 can be manufactured either in a disposable or reusable type. The vent-hole 14 in the hand grip member 1 maintains freshness of the brush means 3 that are kept in the internal space 13 of the hand grip member 1.

The cover member 2 further has a clip member 23 attached thereto to facilitate clipping of the dental cleansing device to the pocket of the user.

The soft brushing threads 322 and the hard hairs 321 which are wound along the brush body 32 of the brush means 3, contact an area and extend deeper into the gaps between teeth without causing injury to the flesh adjacent to the gaps being cleaned. In addition, the cleansing device of the present invention can provide a more thorough cleansing action than the conventional dental cleansing device.

While a preferred embodiment has been explained and described, it will be apparent that many changes and modifications can be made in the general construction and arrangement of the present invention without departing from the scope and spirit thereof. Therefore, it is desired that the present invention be not limited to the exact disclosure but only to the extent of the appended claims.

I claim:

1. A dental cleansing device comprising:

a hollow elongated hand grid member having an internal space with a closed end and an open end and a vent hole which communicates said internal space to an exterior of said hand grip member;

an elongated cover member having an insert end fastened detachably to said open end of said elongated hand grip member and a holding end opposite to said insert end;

said holding end having a brush means including a brush seat attached detachably thereto, an elongated brush body extending substantially perpendicular to said cover member and formed integrally with said brush seat, and a plurality of hairy threads wound around said brush body, said brush means being insertable into said internal space via said open end of said hand grip member when said cover member is detached from said hand grip member and said brush means is detached from said cover member;

wherein said insert end of said cover member has a plurality of axially extending engaging ribs formed on an external surface thereof.

2. The dental cleansing device as defined in claim 1, wherein said elongated cover member further has a clip attached thereto.

* * * * *